US006525298B1

(12) United States Patent
Hunts

(10) Patent No.: US 6,525,298 B1
(45) Date of Patent: Feb. 25, 2003

(54) TOWEL WARMER

(76) Inventor: Barney D. Hunts, 17 Reeve Ave., Stanhope, NJ (US) 07874

( * ) Notice: Subject to any disclaimer, the term of this patent is extended or adjusted under 35 U.S.C. 154(b) by 0 days.

(21) Appl. No.: 09/967,528

(22) Filed: Oct. 1, 2001

(51) Int. Cl.[7] ..... F27D 7/04; F26B 9/06
(52) U.S. Cl. ..... 219/400; 219/385; 219/386
(58) Field of Search ..... 219/385, 386, 219/400, 507–510; 392/379–385

(56) References Cited

U.S. PATENT DOCUMENTS 3,839,622 A * 10/1974 Mastin ..... 219/400
3,924,142 A * 12/1975 Holtkamp ..... 219/510
4,110,600 A * 8/1978 Spotts et al. ..... 219/508
4,464,582 A * 8/1984 Aragaki et al. ..... 219/242
4,644,136 A * 2/1987 Watchman ..... 219/400
4,684,787 A * 8/1987 Bunting ..... 219/400
4,687,906 A * 8/1987 Fujishima et al. ..... 392/383
4,849,610 A * 7/1989 Alvarez ..... 219/400
4,918,290 A * 4/1990 DeMars ..... 219/400
4,927,995 A * 5/1990 Lovett et al. ..... 219/385
5,569,403 A * 10/1996 Swanson et al. ..... 219/400
5,842,287 A * 12/1998 Murphy ..... 219/400
6,005,227 A * 12/1999 Pappas ..... 219/400
6,046,436 A * 4/2000 Hunts ..... 219/400
6,175,970 B1 * 1/2001 Pinciaro ..... 4/541.4

* cited by examiner

*Primary Examiner*—Joseph Pelham
(74) *Attorney, Agent, or Firm*—Alfred C. Hill

(57) ABSTRACT

A hot air towel warmer comprising a substantially air tight enclosure having an access door to enable placing a towel to be warmed in the enclosure and to enable removing the warmed towel therefrom; a shelf disposed within the enclosure having perforations therethrough to support the towel; a blower disposed within the enclosure adjacent to the shelf to create a stream of air and to continuously circulate the stream of air within the enclosure for passage through the perforations of the shelf and the towel; a resistance coil heater disposed within the enclosure adjacent the blower to heat the stream of air; an electrical control circuit disposed within the enclosure associated with the stream of air, the blower and the heater to automatically maintain the stream of air at a temperature within a predetermined temperature range for a given period of time or until the access door is open, whichever comes first and to prevent scorching of the towel should a short circuit occur in the parts of the electrical control circuit; and various embodiments to permanently secure the hot air towel warmer to prevent the warmer from falling into either a tub or a shower enclosure.

11 Claims, 6 Drawing Sheets

TOWEL WARMER

BACKGROUND OF THE INVENTION

The present invention relates to a hot air towel warmer and more particularly to an improved hot air towel warmer.

As pointed out in U.S. Pat. No. 6,046,436, whose patentee is the same as the applicant of the present application, the feel of a uniformly warm towel against the skin immediately after a shower or a bath is a delight that is only rarely enjoyed. If enjoyed in ones home before the inception of the hot air towel warmer of U.S. Pat. No. 6,046,436, it was only because one has managed to complete a shower shortly after having run a load of towels through the washer and dryer.

Experience has shown that the pleasure of a warm towel against the skin is diminished as the distance from the tub or shower to the towel warmer increases. Therefore, to be commercially viable, a towel warmer must be aesthetically pleasing and space economical while simultaneously satisfying the uniform building code which disallows duplex outlets close to tubs or showers.

SUMMARY OF THE INVENTION

An object of the present invention is to provide a safe, permanently installed towel warmer which is more desirable and user friendly since it can be placed in close proximity to a tub or shower thereby satisfying the uniform building code requirements which disallow duplex electrical outlets in close proximity to tubs or showers as a precaution against electrocution when live portable electrical appliances are inappropriately used, or dropped into occupied tubs or showers containing standing water.

Permanently installed electrical devices, such as lights, area heaters and exhaust fans do not have the same proximity restrictions, since they cannot be physically displaced into the tub area, and it is an object of the present invention to satisfy the safety criteria by the same approach.

Another object of the present invention is to prevent the possibility of igniting the towel in the unlikely event of short circuit failure of the primary temperature sensor, or heater coil power sequencing switch.

A rarely occurring but recognized failure mode of triacs is an electrical short from anode to cathode. Similarly, relays have been known to fail by self fusing the contacts to create an electrical short circuit. Since either a triac or a relay is required to allow the control electronics to modulate power to the heating element and thereby control the temperature within the antechamber, the present invention provides a thermal circuit breaker, or a bimetallic temperature sensor/switch located within the antechamber, (thermal accumulator/supply plenum) with a switch temperature (approximately 300° F.) above the level maintained by the control electronics, but below the ignition temperature of cotton. This switch will in all likelihood never be activated during the entire lifetime of the towel warmer. Its sole purpose is to prevent towel ignition in the unlikely event of a short circuit failure of either the temperature control sensor, or power switch (triac or relay) which sequences the heater coil on and off to control air temperature.

The ultimate purpose of the disclosed towel warmer is to uniformly heat a towel to a predetermined end temperature within the short time duration of a typical shower (about 7 to 10 minutes) without any possibility of scorching the towel. To do so one must take advantage of the established thermodynamic principle which states that the rate of heat transfer (dH) from a warmer to a cooler body is in direct proportion to the temperature difference (dT) between the bodies and in inverse proportion to the distance between the bodies (D), stated mathematically: $dH=K\ (dT/D)$. The disclosed towel warmer is configured to control two simultaneous heat exchange interactions; one between the electric heating coil and the return ambient air passing through it, and the second between the heated air within the towel heating chamber and the cotton fibers within the towel.

A further object of the present invention is to maintain the greatest possible dynamic temperature differential and the smallest possible heat path (distance) in each of these exchange interactions in order to maximize the actual rate of heat flow between the heater element and the individual towel fibers and thereby to minimize the time required to heat the towel.

Still a further object of the present invention is to reduce the overall size (volume) of the entire towel warmer enclosure such that the unit can be inconspicuously installed in bathrooms so designers, or remodeling contractors, can complete installation without impacting either the room esthetics, or the available counter space.

A feature of the present invention is the provision of a hot air towel warmer comprising a substantially air tight enclosure having a sealable access means to enable placing a towel and the like to be warmed in the substantially air tight enclosure and to enable removing a warmed towel therefrom; first means disposed within the substantially air tight enclosure having air passages therethrough to support the towel; second means disposed within the substantially air tight enclosure adjacent the first means to create a stream of air and to continuously circulate the stream of air within the substantially air tight enclosure for passage through the first means and the towel; third means disposed within the substantially air tight enclosure adjacent the second means to heat the stream of air; fourth means disposed within the substantially air tight enclosure associated with the stream of air, the second means and the third means to automatically maintain the stream of air at a temperature within a predetermined temperature range for a given period of time; and fifth means disposed within the substantially air tight enclosure associated with the stream of air, the third means and the fourth means to detect a short circuit in either one of the third means and the fourth means to prevent towel ignition in the unlikely event of such a short circuit.

Another feature of the present invention is the provision of a hot air towel warmer comprising a substantially air tight enclosure having a sealable access means to enable placing a towel and the like to be warmed in the substantially air tight enclosure and to enable removing a warmed towel therefrom; first means disposed within the substantially air tight enclosure having air passages therethrough to support the towel; second means disposed within the substantially air tight enclosure adjacent the first means to create a stream of air and to continuously circulate the stream of air within the substantially air tight enclosure for passage through the first means and the towel; third means disposed within the substantially air tight enclosure adjacent the second means to heat the stream of air; fourth means disposed within the substantially air tight enclosure associated with the stream of air, the second means and the third means to automatically maintain the stream of air at a temperature within a predetermined temperature range for a given period of time; and fifth means associated with the substantially air tight enclosure to enable permanent installation of the hot air towel warmer within a bathroom in close proximity to a selected one of a tub and a shower such that the hot air towel warmer is incapable of being displaced into a selected one of a tub and a shower.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
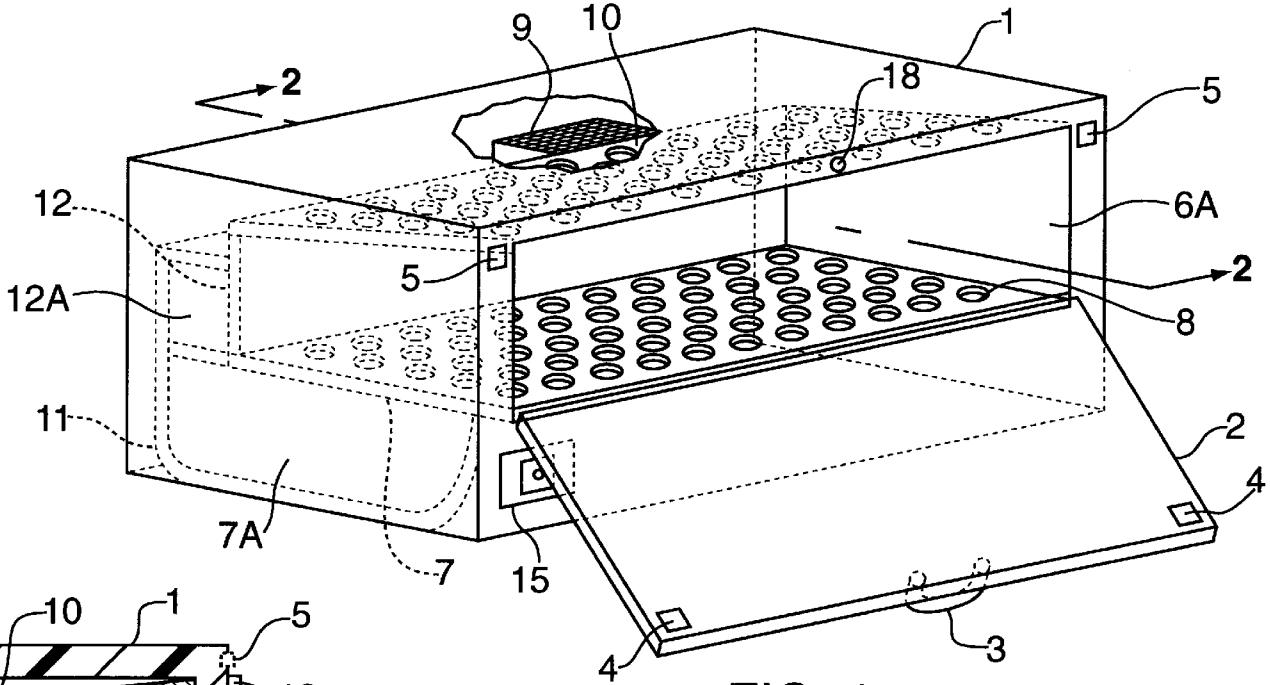
FIG. 1 is a perspective view of the hot air towel warmer in accordance with the principles of the present invention.
Figure 2:
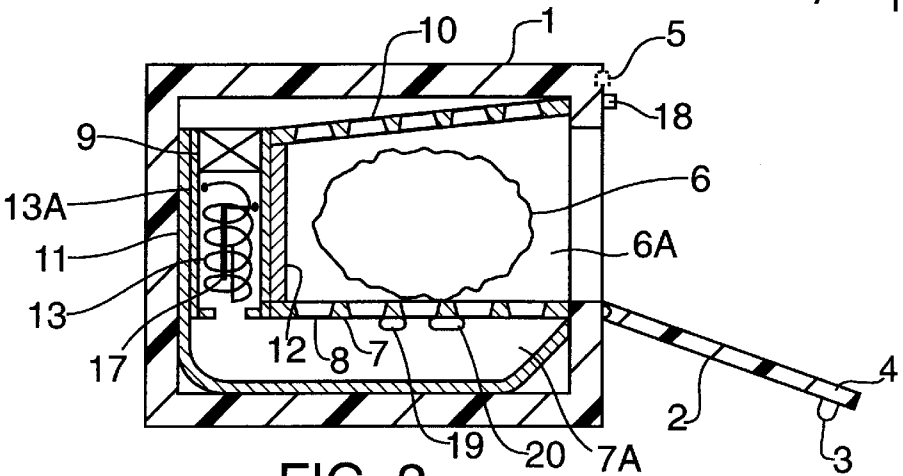
FIG. 2 is a cross-sectional view of the hot air towel warmer taken along line 2—2 at FIG. 1.

Referring to FIGS. 1 and 2, the hot air towel warmer in accordance with the principles of the present invention includes a substantially air tight enclosure 1 having a sealable access means in the form of a door 2 which is moveable into a closed position by handle 3 and held in a closed position by a magnet or similar catches 4 and 5. Door 2 enables placing a towel 6 to be warmed in the enclosure 1 and to enable removing the warm towel 6 from enclosure 1. As illustrated at FIG. 2, the towel 6 is in a rumpled condition, but it could just as well be in a neatly folded condition, since regardless of the condition of towel 6, the towel 6 is completely warmed throughout its bulk by means of total immersion in the temperature controlled forced hot air being circulated within enclosure 1.

A first means in the form a shelf 7 having air passages therethrough in a form of perforations 8 is disposed within the air tight enclosure 1 to support the towel 6.

A second means in the form of a blower 9 adjacent the rear of enclosure 1 creates a stream of air and continuously circulates the stream of air within the enclosure 1 for passage through the shelf 7 and the towel 6 being returned to blower 9 through the perforated baffle 10. Baffles 11 and 12 are provided to ensure that the air stream is directed through the towel 6, the shelf 7 and the baffle 10. The perforated baffle 10 is provided to ensure that the towel 6 is not sucked into the return of blower 9 and to maintain the towel 6 within the space defined by the shelf 7 and the perforated baffle 10. Baffles 7 and 11 further define a temperature controlled antechamber 7A separating the heating coil chamber 13A and the towel warmer chamber 6A.

A third means in the form of a resistance coil heater 13 is disposed in chamber 13A of enclosure 1 adjacent the blower 9 to heat the air stream and, hence, the towel 6. Space 12A provides sufficient volume to contain control electronic circuitry of FIG. 3. The spaces 12A and 13A are separate internal spaces to thermally insulate the control electronics from heater coil 13.

Figure 3:
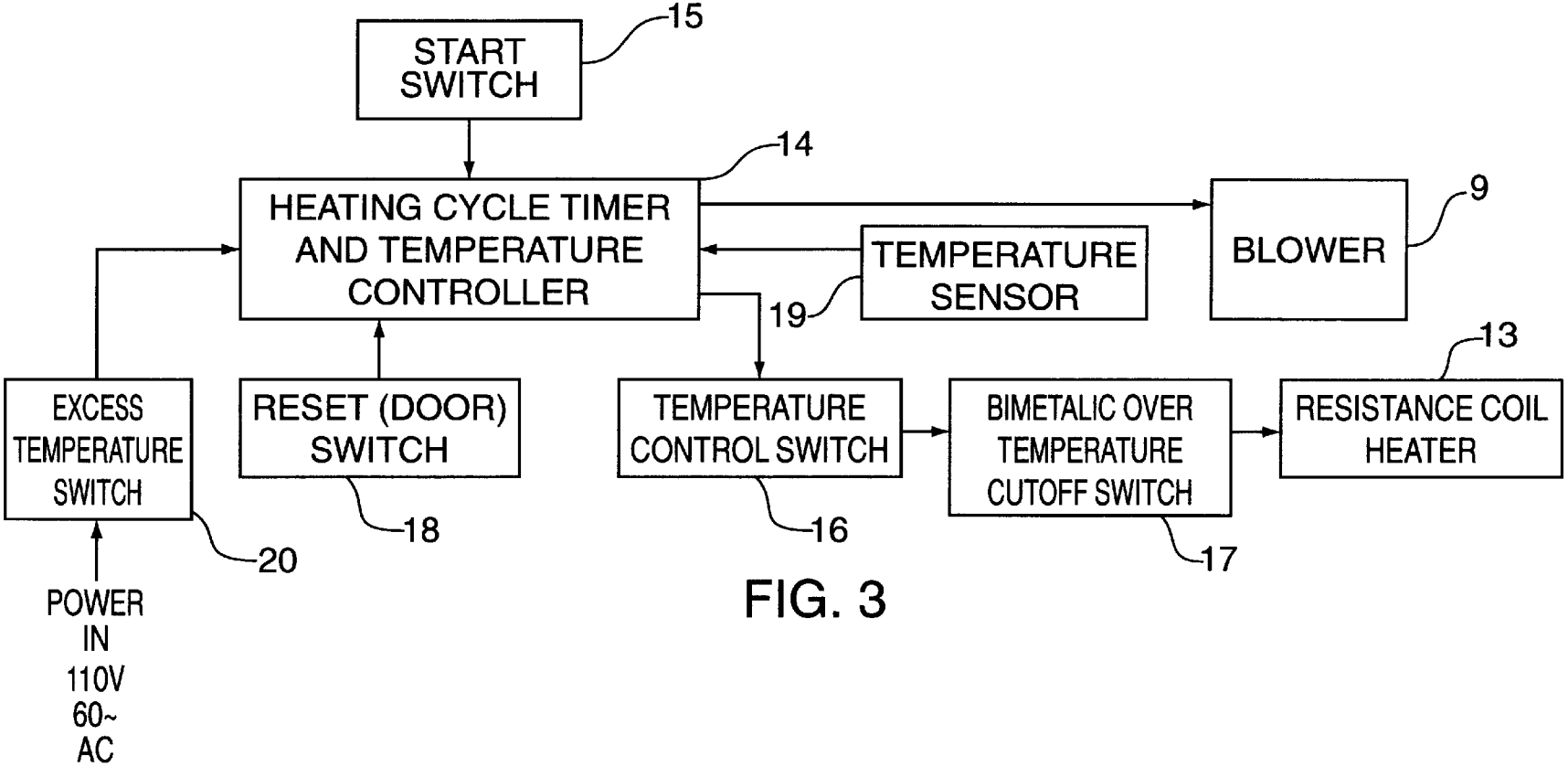
FIG. 3 is a block diagram of the electrical control system of the hot air towel warmer in accordance with the principles of the present invention.

The operation of the hot air towel warmer, in accordance with the principle of the present invention, is controlled by an electrical circuit, shown in block diagram form in FIG. 3 which together with temperature sensor 19, placed within the antechamber plenum 7A defined by baffles 7 and 11 constitutes the fourth means of the device to automatically maintain the stream of air at a temperature within a predetermined temperature range for a given period of time.

Referring to FIG. 3, the main control to establish the predetermined time and temperature range is provided by the heating cycle timer and temperature controller 14 which includes therein electrical circuitry to provide a predetermined period of time for the heating cycle and the predetermined temperature range for the stream of air within antechamber 7A. Controller 14 couples the power for operation of blower 9 and the resistance coil heater 13 for a predetermined period of time established by any known timer circuit and an electrical circuit that establishes the range of temperature within which it is desired to maintain the stream of air to accomplish the heating of towel 6. The heating cycle is started by the start switch 15 which may be placed in any convenient position on the enclosure 1, one of which is shown in FIG. 1. The controller 14 couples the power to blower 9 throughout the predetermined period of time with the power to heater 13 being interrupted by the temperature control switch 16 and/or the bimetallic overtemperature cut off switch 17, only temperature control switch 16 being under direct control of and subject to interruption by temperature controller 14. A temperature sensor 19 is located in the path of the stream of air where it first encounters the towel such that it measures the hottest temperature applied to the towel. By this means, a temperature high enough to achieve rapid heat transfer to the towel can be maintained within antechamber 7A without any danger of scorching the towel as illustrated at 19 in FIG. 2. The cut off switch 17 illustrated in FIG. 2 will cut off the power to the heater 13 if the blower fan ceases to function for any reason, thus preventing overheating of the heater coil 13 which is dependent on the forced air flow for its, cooling. The operating cycle will be interrupted and reset by the contact switch 18 when door 2 is open. When door 2 is opened switch 18 resets the controller 14 which is then ready for another cycle of operation to warm another towel, or the same towel, when starter switch 15 is operated. An excess temperature switch 20 is provided beneath shelf 7 as illustrated in FIG. 2 to protect the towel from scorching should a short occur in the electronic system as previously mentioned. If the excess temperature switch 20 senses a high temperature indicating a short circuit it will cut all power to the hot air towel warmer 1.

The control arrangement as shown in FIG. 3 is such that controller 14 will always supply power to blower 13 during a predetermined period of time as well as the power to the resistance coil 13 which will be interrupted by the temperature control switch 16 when the temperature of the air stream reaches the maximum desired level, and power will then be restored when the air temperature drops approximately 5° F. to its lower desired level, thus establishing a predetermined temperature range. The cut off switch 17 interrupts the power to heater 13 if the air stream is interrupted to prevent overheating of the heating coil 13.

The given time period provided in controller 14 is selected to be longer than the time consumed by a normal shower or bath so that the warm towel will be available to the occupant of the shower or bath when the shower or bath is completed, but the unit will shut off automatically should the individual fail to open the access door 2 for any reason. Temperature sensor 19 and control switch 16 and the excess temperature switch 20 can be provided by a bimetallic switch. This would be the simplest embodiment of sensor 19, switch 16 and switch 20, would be inexpensive and would combine temperature sensing and control switch in a single unit. A disadvantage might be the ability of the bimetallic switch 16 to maintain a 5° F. deadband from about 210° F. to 215° F. and to operate "hot" for many cycles of use during its lifetime. The preferred embodiment of sensor 19 and control switch 16 is by means of a thermistor, level detecting amplifier and triac solid state switch. In this embodiment the triac control switch 16 is co-located with the temperature control electronic 14. This arrangement essentially has an infinite "hot" switch lifetime and solid state reliability although at a higher cost than the bimetallic switch arrangement.

Figure 4:
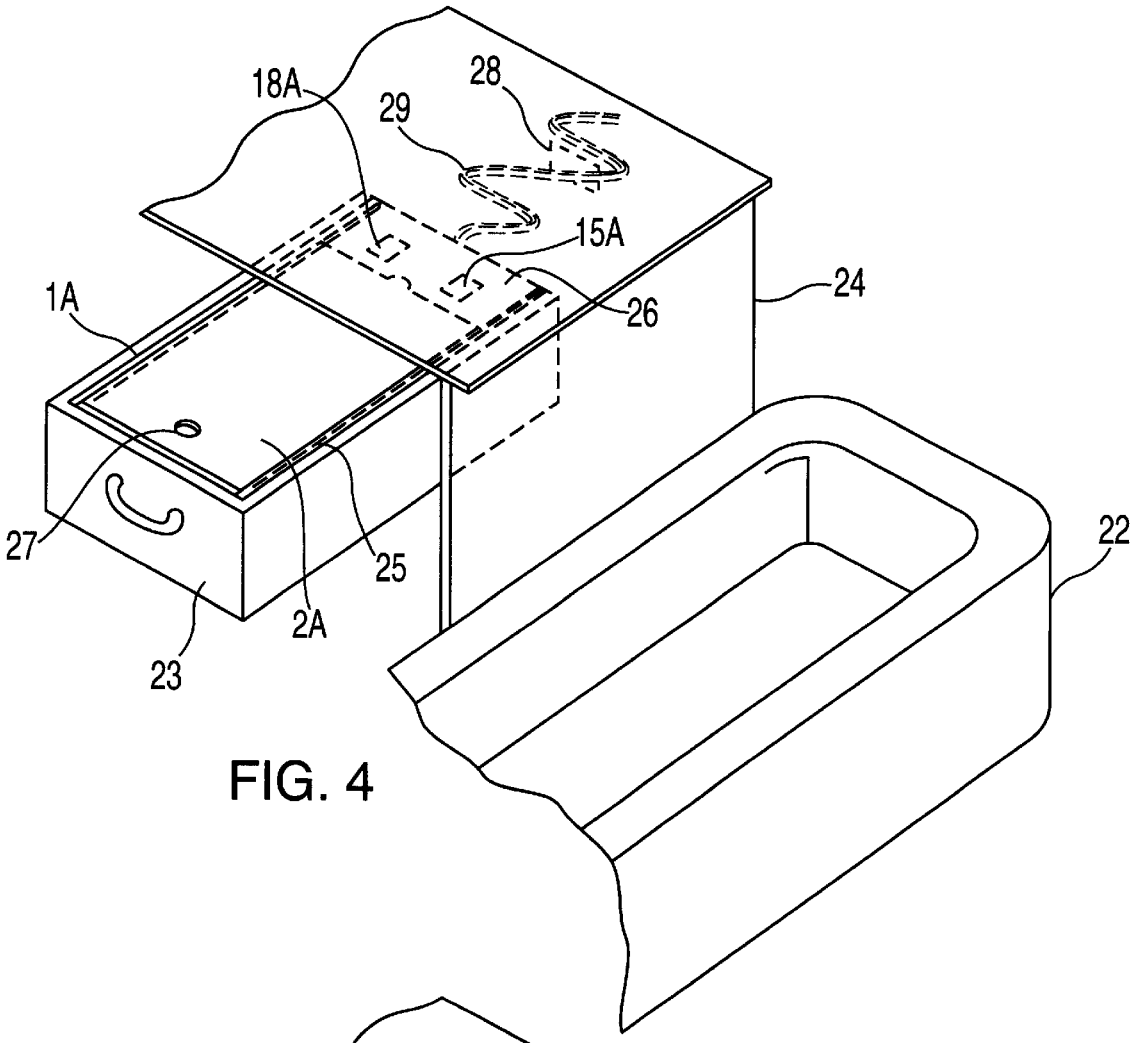
FIG. 4 is a perspective view of a first embodiment for placing the hot air towel warmer within a drawer of an existing or planned vanity within close proximity to a tub or a shower with the access door closed in accordance with the principles of the present invention.
Figure 5:
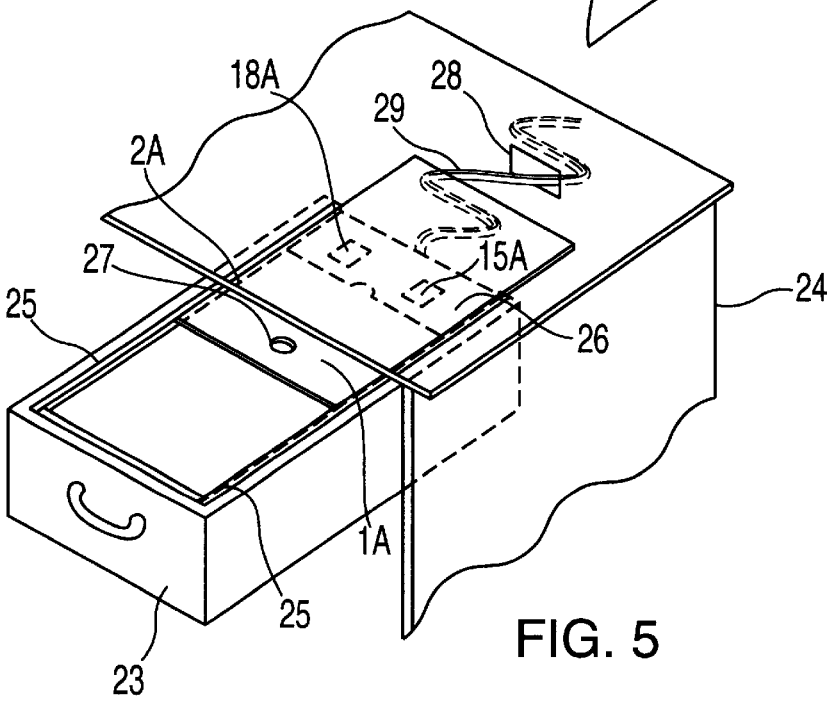
FIG. 5 is a perspective view of the first embodiment of the hot air towel warmer with the access door open in accordance with the principles of the present invention.

Referring to FIGS. 4 and 5, there is illustrated therein one of the embodiment to enable permanent installation of the hot air towel warmer of FIGS. 1 and 2 within a bathroom to prevent the hot air towel warmer from falling into a selected one of a tub and shower shown in FIG. 4 to be tub 22. The enclosure 1A of the hot air towel warmer is dimensioned to fit within a drawer 23 of a vanity 24 adjacent tub 22. The access means 2A of FIG. 4 is on the top of the enclosure 1A. The start switch 15 and door open switch 18 are embedded within the drawer insert unit or enclosure 1A and actuated by position detection switches 15A and 18A, respectively, as access means 2A or top slides to the rear, as shown in FIG. 5, and back. Switches 15A and 18A are both "transparent" to the user by means of the controller logic. Access means 2A slides on tracks 25 and between tracks 25 and member 26 by means of finger moving means 27. Power is supplied to the towel warmer by hardwiring from receptacle 28 to the control circuitry of the towel warmer by a power cord 29 which will expand when the drawer 23 is pulled out and which will retract when the drawer 23 is closed. Power cord 26 is a swing arm power cord, a single loop of which equals two times drawer 23 width, or drawer 23 pull.

Figure 6:
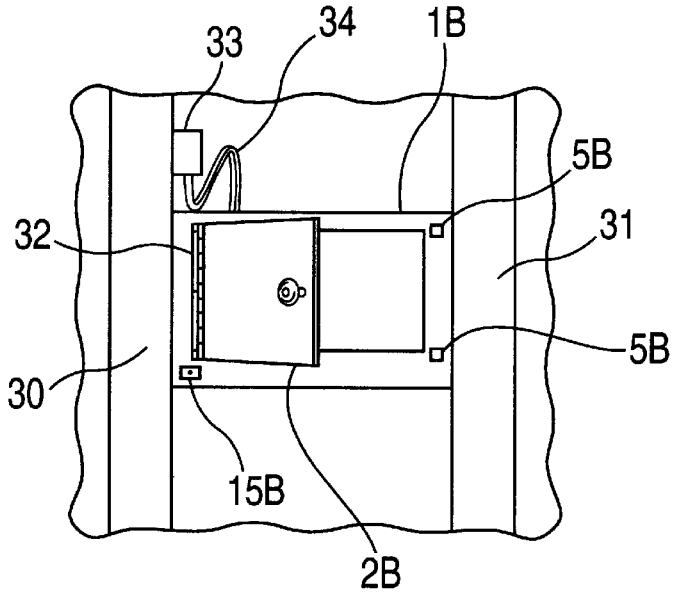
FIG. 6 is a front view of a second embodiment for permanently securing the hot air towel warmer in a bathroom embedded within the wall between adjacent studs in accordance with the principles of the present invention.
Figure 7:
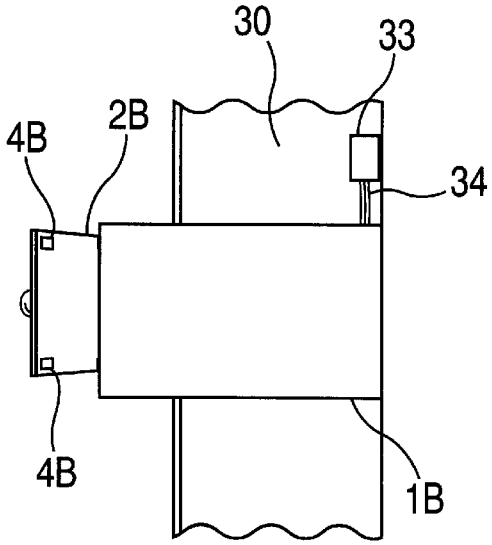
FIG. 7 is a side view of the second embodiment of FIG. 6.

In the embodiment shown in FIGS. 6 and 7, the towel warmer of FIGS. 1 and 2 is disposed between two studs 30 and 31. In this embodiment the enclosure 1B is secured to the studs 30 and 31 to hold it in position and the sealable access means 2B is provided with a piano hinge 32 that is hinged to the front surface adjacent and parallel to one of the two sides the air tight enclosure 1B. The magnetic catches 5B cooperate with the magnetic catches 4B on the access means 2B to sealably close the substantially air tight enclosure 1B. Power is provided to the enclosure 1B by hardwiring from electrical box 33 with the conductor 34.

Figure 8:
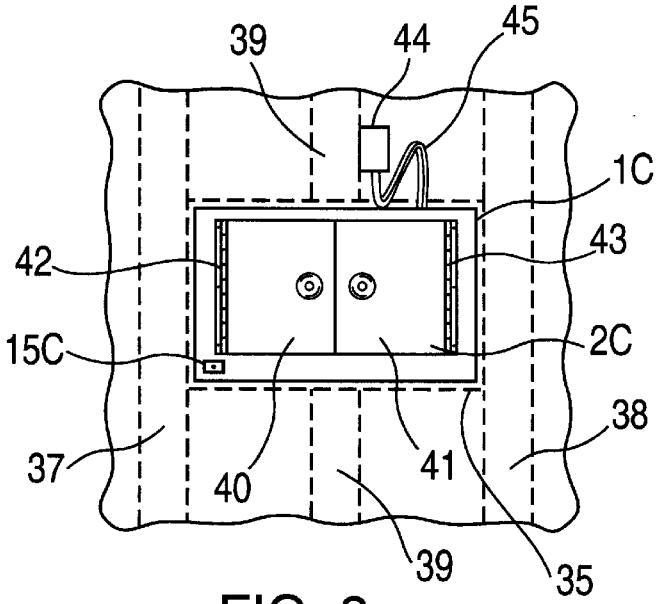
FIG. 8 is a front view of a third embodiment for permanently securing the hot air towel warmer in a bathroom embedded within the wall between two studs separated by at least one other stud in accordance with the principles of the present invention.

Referring to FIG. 8, there is illustrated therein another embodiment for permanently securing the towel warmer in accordance with the principles of the present invention which is capable of warming oversize, or "towel sheets" as they are commonly known. The enclosure 1C is secured in a cavity 35 disposed in a wall 36 between two spaced studs 37 and 38 separated by at least one stud 39 that is removed between the two spaced studs 37 and 38. The access means 2C in this embodiment is provided by two sealable doors 40 and 41 hinged to the front surface of the enclosure 1C by the piano hinges 42 and 43. The start button 15C is provided in the front surface of the enclosure 1C and the power is provided to the enclosure 1C by an electrical box 44 which is hardwired to the enclosure 1C by the wire 45.

The access means 2C for the enclosure 1C could be provided by a single door in the front surface of the enclosure 1C hinged at the bottom or top of this single door to provide access for inserting a towel to be warmed and for removing a warmed towel.

Figure 9:
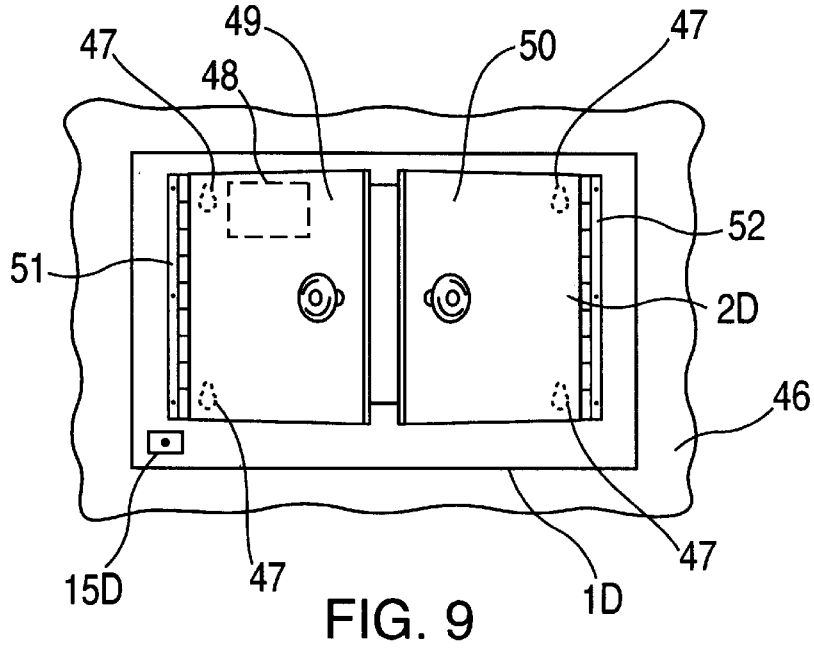
FIG. 9 is a front view of a fourth embodiment of the hot air towel warmer contained within a cabinet secured to the wall of a bathroom in accordance with the principles of the present invention.

Referring to FIG. 9, there is illustrated another embodiment of permanently securing the towel warmer to a bathroom wall 46 by providing in the enclosure 1D key holes 47. A receptacle 48 is also provided to hardwire the enclosure 1D to the electrical system of the bathroom. The start switch 15D is contained on the front surface of enclosure 1D. The access means 2D is provided by two doors 49 and 50 which are hinged to the front surface of enclosure 1D by the piano hinges 51 and 52 disposed adjacent and parallel to the two sides of the air tight enclosure 1D.

It should be recognized that the access means 2D could be provided as illustrated in FIG. 1 which includes only one door hinged onto the front surface adjacent and parallel to the bottom of the enclosure 1D.

Figure 10:
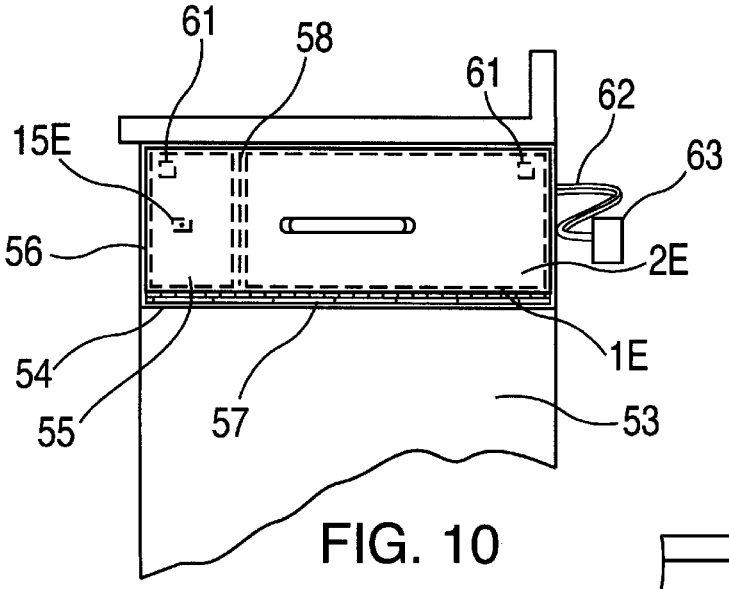
FIG. 10 is a front view of a fifth embodiment for permanently securing the hot air towel warmer in a bathroom fastened to an end wall of a vanity in accordance with the principles of the present invention.
Figure 11:
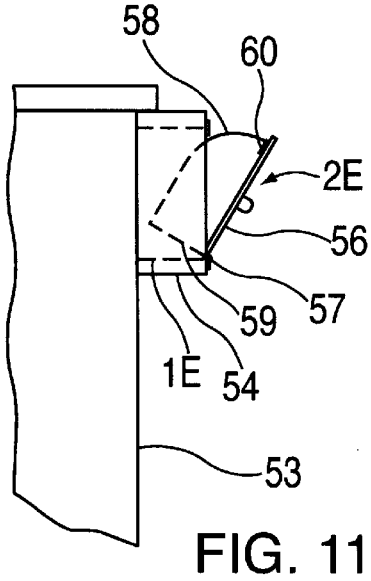
FIG. 11 is a side view of the hot air towel warmer of FIG. 10.

Referring to FIGS. 10 and 11, there is illustrated another embodiment permanently securing the enclosure 1E of the towel warmer of FIGS. 1 and 2 in accordance with the principles of the present invention. In the embodiment shown in FIGS. 10 and 11, the enclosure 1E is secured to a sidewall of a vanity 53 adjacent a selected one of a tub and a shower. Enclosure 1E is contained in container 54 which provides a compartment 55 for the electronic control circuitry. The various chambers of the hot air towel warmer of FIGS. 1 and 2 are contained in the rest of container 54. Access means 2E is provided by a member 56 rotatable on piano hinge 57 as illustrated in FIG. 11 to enable insertion of a towel to be warmed and removal of a warmed towel from the hot air towel warmer of FIGS. 1 and 2. Rotatable member 56 is enclosed on all five sides to prevent the towel from being lodged behind or under member 56. Perforated member 59 corresponds to shelf 7 of FIGS. 1 and 2. As in FIGS. 1 and 2 member 59 holds the towel to be warmed, placed therein through opening 58 upon closing member 56 and to enable removal of the towel for use through opening 58 when member 56 is opened. Member 56 is held in its closed position by magnets 60 mating with the other half 61 of a magnetic catch. Power to enclosure 1E is provided by conductor 62 hardwired to electrical box 63 disposed in the wall of the bathroom.

Figure 12:
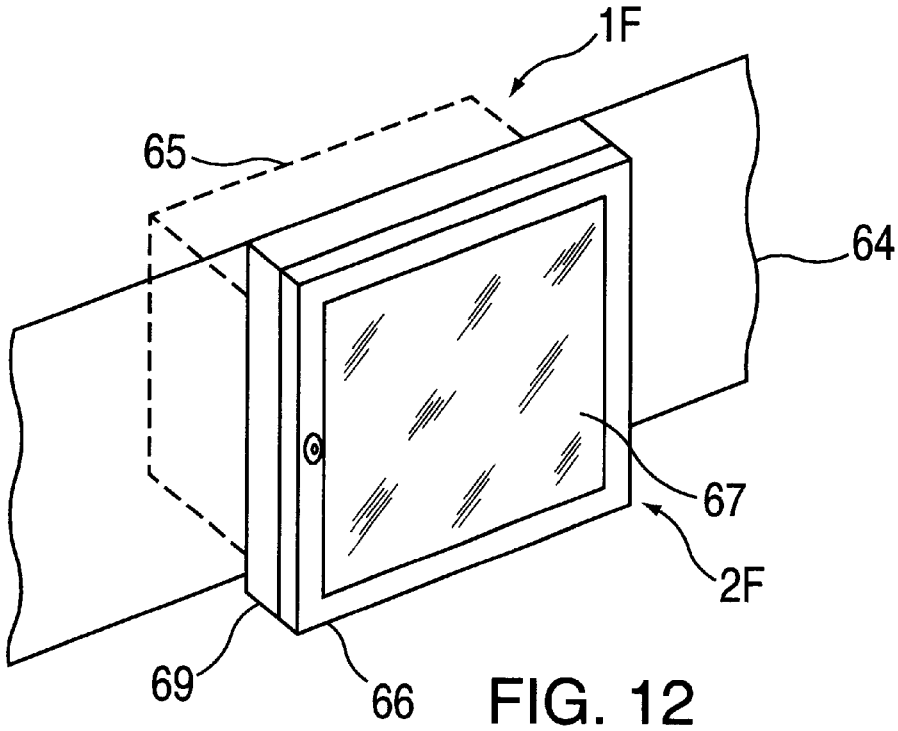
FIG. 12 is a perspective view of a sixth embodiment for permanently securing the hot air towel warmer in a bathroom contained in a cabinet embedded in a wall of a bathroom with the door closed in accordance with the principles of the present invention.
Figure 13:
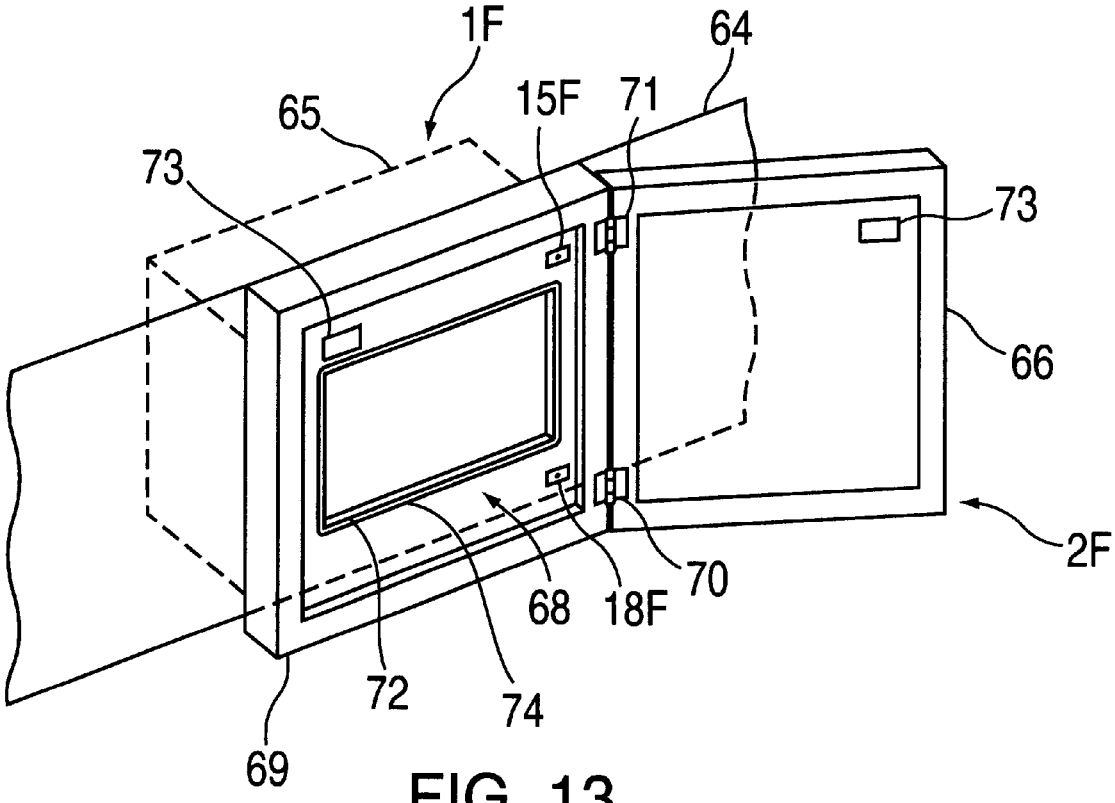
FIG. 13 is a perspective view of FIG. 12 with the door open in accordance with the principles of the present invention.

Referring to FIGS. 12 and 13, there is illustrated another embodiment permanently securing enclosure 1F of the towel warmer of FIGS. 1 and 2 mounted on and within wall 64. The major part 65 of enclosure 1F is embedded in wall 64 with the access means 2F including a door 66 containing on an outer surface thereof a mirror 67. Access means 2F includes a member 68 contained in a box 69 to which door 66 is hinged by hinges 70 and 71. Member 68 contains thereon an opening 72 through which a towel to be warmed is inserted and from which the warmed towel is removed. During the towel warming process door 66 is hold in a closed position by magnetic catch 73. Opening 72 has a sealing material 74 therearound to ensure a seal for the access means 2F.

While I have described above the principles of my invention in connection with specific apparatus, it is to be clearly understood that this description is made only by way of example and not as a limitation to the scope of my invention as set forth in the objects thereof and in the accompanying claims.

I claim:

1. A hot air towel warmer comprising:

a substantially air tight enclosure having-a sealable access means to enable placing a towel and the like to get warmed in said substantially air tight enclosure and to enable removing a warmer towel therefrom;

first means disposed within said substantially air tight enclosure having air passages therethrough to support said towel;

second means disposed within said substantially air tight enclosure adjacent-said first means to create a stream of air and to continuously circulate said stream of air within said substantially air tight enclosure for passage through said first means and said towel;

third means disposed within said substantially air tight enclosure adjacent said second means to heat said stream of air;

fourth means disposed within said substantially air tight enclosure associated with said stream of air, said second means and said third means to automatically maintain said stream of air at a temperature within a predetermined temperature range for a given period of time;

fifth means disposed within said substantially air tight enclosure associated with said stream of air, said third means and said fourth means to detect a short circuit in either one of said third means and said fourth means due to a malfunction in either one of said third means and said fourth means to prevent towel ignition in the unlikely event of such a short circuit; and sixth means associated with said substantially air tight enclosure to enable permanent installation of said hot air towel warmer within a bathroom to prevent said hot air towel warmer from falling into a selected one of a tub and a shower;

said sixth means including a vanity drawer adjacent said selected one of a tub and a shower, said substantially air tight enclosure being disposed in said vanity drawer, said sealable access means is slidably disposed in a top of said substantially air tight enclosure, an electrical power source disposed behind said vanity drawer, and a flexible connection between said electrical power source and said third means and said fourth means of said substantially air tight enclosure.

2. A towel warmer according to claim 1, further including switch means associated with said second means, said third means, said fourth means and said sealable access means responsive to the position of said sealable access means to turn said hot air towel warmer ON and OFF.

3. A hot air towel warmer comprising:

a substantially air tight enclosure having a sealable access means to enable placing a towel and the like to get warmed in said substantially air tight enclosure and to enable removing a warmed towel therefrom;

first means disposed within said substantially air tight enclosure having air passages therethrough to support said towel;

second means disposed within said substantially air tight enclosure adjacent said first means to create a stream of air and to continuously circulate said stream of air within said substantially air tight enclosure for passage through said first means and said towel;

third means disposed within said substantially air tight enclosure adjacent said second means to heat said stream of air;

fourth means disposed within said substantially air tight enclosure associated with said stream of air, said second means and said third means to automatically maintain said stream of air at a temperature within a predetermined temperature range for a given period of time; and fifth means associated with said substantially air tight enclosure to enable permanent installation of said hot air towel warmer within a bathroom in close proximity to a selected one of a tub and a shower such that said hot air towel warmer is incapable of being displaced into said selected one of a tub and a shower;

said fifth means includes a vanity drawer adjacent said selected one of a tub and a shower, said substantially air tight enclosure disposed in said vanity drawer, said sealable access means slidably disposed in a top of said substantially air tight enclosure, an electrical power source disposed behind said vanity drawer, and a flexible connection between said electrical power source and said third means and said fourth means of said substantially air tight enclosure.

4. A towel warmer according to claim 3, further including switch means associated with said second means, said third means, said fourth means and said sealable access means responsive to the position of said sealable access means to turn said hot air towel warmer ON and Off.

5. A hot air towel warmer comprising;

a substantially air tight enclosure having a sealable access means to enable placing a towel and the like to get warmed in said substantially air tight enclosure and to enable removing a warmed towel therefrom;

first means disposed within said substantially air tight enclosure having air passages therethrough to support said towel;

second means disposed within said substantially air tight enclosure adjacent said first means to create a stream of air and to continuously circulate said stream of air within said substantially air tight enclosure for passage through said first means and said towel;

third means disposed within said substantially air tight enclosure adjacent said second means to heat said stream of air;

fourth means disposed within said substantially air tight enclosure associated with said stream of air, said second means and said third means to automatically maintain said stream of air at a temperature within a predetermined temperature range for a given period of time;

fifth means associated with said substantially air tight enclosure to enable permanent installation of said hot air towel warmer within a bathroom in close proximity to a selected one of a tub and a shower such that said hot air towel warmer is incapable of being displaced into said selected on of a tub and a shower; and switch means associated with said second means, said third means said fourth means and said sealable access means responsive to the position of said sealable access means to turn said hot air towel warmer ON and OFF.

6. A towel warmer according to claim 5, wherein said fifth means includes a vanity drawer adjacent said selected one of a tub and a shower, said substantially air tight enclosure disposed in said vanity drawer, said sealable access means is slidably dispoased in said top of said substantially air tight enclosure, an electrical power source disposed behing said vanity drawer, and a flexible connection between said electricl power source and said third means and said fourth means of said substantially air tight enclosure.

7. A towel warmer according to claim 5, wherein said fifth means includes a cavity disposed in a wall of said bathroom between adjacent studs of said wall, said cavity being disposed adjacent said selected one of a tub and a shower to permanently receive said substantially air tight enclosure therein, said sealable access means is disposed in an exposed front surface of said substantially air tight enclosure, and an electrical power source disposed in said cavity connected to said third means and said fourth means of said substantially air tight enclosure.

8. A towel warmer according to claim 5, wherein said fifth means includes a cavity disposed in a wall of said bathroom between two spaced studs of said wall separated by at least one stud of said wall that is removed between said two spaced studs, said cavity being disposed adjacent said selected one of a tub and a shower to permanently receive an oversized version of said substantially air tight enclosure therein, said sealable access means is disposed in an exposed front of said oversized version of said substantially air tight enclosure, and an electrical power source disposed in said cavity connected to said third means and said fourth means of said oversized version of said substantially air tight enclosure.

9. A towel warmer according to claim 5, wherein said fifth means includes a sixth means disposed in a back of said substantially air tight enclosure to enable mounting said substantially air tight enclosure on a wall of said bathroom, said sealable access means being disposed in a front surface of said substantially air tight enclosure, and an electrical power source disposed in said wall of said bathroom adjacent and passed through said back of said substantially air tight enclosure connected to said third means and said fourth means of said substantially air tight enclosure.

10. A towel warmer according to claim 5, wherein said fifth means includes a wall mounted cabinet permanently secured to a wall of said bathroom to permanently receive said substantially air tight enclosure within said wall mounted cabinet and partially embedded in said wall of said bathroom, said sealable access means being disposed in an exposed surface of said substantially air tight enclosure, and an electrical power source disposed in said wall behind said wall mounted cabinet connected through a back of said wall mounted cabinet and a back of said substantially air tight enclosure to said third means and said fourth means of said substantially air tight enclosure.

11. A towel warmer according to claim 5, wherein said fifth means includes a cabinet secured to a sidewall of a vanity adjacent said selected one of a tub and a shower containing said substantially air tight enclosure, said sealable access means includes a rotating cavity having a closed front, back and sides, an open top and a perforated bottom providing said first means, and an electrical power source disposed in a wall of said bathroom adjacent said side wall of said vanity hard wired to said third means and said fourth means of said substantially air tight enclosure.

* * * * *